US005287655A

United States Patent [19]

Harvey

[11] Patent Number: 5,287,655

[45] Date of Patent: Feb. 22, 1994

[54] ROLLER ARRANGEMENT FOR SLIDING PANELS

[75] Inventor: Daniel H. Harvey, Placentia, Calif.

[73] Assignee: Metal Industries, Inc., Elizabehtville, Pa.

[21] Appl. No.: 24,374

[22] Filed: Mar. 1, 1993

[51] Int. Cl.[5] ..... E05D 13/00

[52] U.S. Cl. ..... 49/425; 49/420; 49/421

[58] Field of Search ..... 49/414, 415, 416, 417, 49/420, 421, 425, 427, 404; 16/91, 97, 105, 106; 160/369, 371, 376

[56] References Cited

U.S. PATENT DOCUMENTS

| | | | |
|---|---|---|---|
| 1,553,306 | 9/1925 | Busby | 49/420 |
| 1,737,944 | 12/1929 | Pollack | 160/376 X |
| 2,207,198 | 7/1940 | Herman | 160/376 X |
| 3,283,444 | 11/1966 | Andres | 49/420 |
| 3,416,183 | 12/1968 | Martin | 49/420 X |
| 3,716,890 | 2/1973 | Benson | 49/420 X |
| 3,879,893 | 4/1975 | Helmick | 49/425 X |
| 3,959,849 | 6/1976 | Marquardt | 49/420 X |
| 4,064,593 | 12/1977 | Helmick | 49/425 X |
| 4,077,160 | 3/1978 | Stewart | 49/421 |
| 4,112,622 | 9/1978 | Stewart | 49/425 X |
| 4,189,870 | 2/1980 | Helmick | 49/425 X |
| 4,353,186 | 10/1982 | Offterdinger | 49/425 X |

FOREIGN PATENT DOCUMENTS

| | | | |
|---|---|---|---|
| 2461857 | 10/1975 | Fed. Rep. of Germany | 49/425 |

*Primary Examiner*—Peter M. Cuomo
*Assistant Examiner*—Jerry Redman
*Attorney, Agent, or Firm*—Anthony F. Cuoco

[57] ABSTRACT

A sliding panel includes a frame having top, bottom and side members. Expanders rotatably supporting rollers are partially disposed within the top and bottom members and are displaceable against spring tension inwardly and outwardly of said members. Clips are provided for retaining the expanders partially disposed within the top and bottom members and for limiting the outward displacement of the expanders. The arrangement described provides self-leveling of the rollers along the entire width of the panel.

10 Claims, 2 Drawing Sheets

ROLLER ARRANGEMENT FOR SLIDING PANELS

BACKGROUND OF THE INVENTION

It is usual in the prior art to provide sliding panels, such as screen or glass doors and the like, with rollers supported in channels at the top and bottom edges of the door. The rollers, in turn, ride on appropriate tracks on the top and bottom of the door opening. It is also usual in the prior art for the rollers to be spring biased so as to permit the door to be positioned in the tracks by a simple manipulation, and to permit the doors to be easily removed from the tracks, as may be required.

It is important that the rollers are adjustable so that they can freely ride in the tracks and thus avoid binding of the panel in the tracks as the panel slides from one position to another, and to accommodate slight variations in the size of the panel opening and/or out-of-square conditions, imperfections, etc. which may exist in said opening.

The following prior art relates generally to the invention disclosed herein: U.S. Pat. No. 3,722,028 (U.S. Class 16/91) which issued to Schoenbrod on Mar. 27, 1973; U.S. Pat. No. 4,064,593 (U.S. Class 16/105) which issued to Helmick on Dec. 27, 1977; U.S. Pat. No. 4,112,622 (U.S. Class 49/421) which issued to Stewart on Sept. 12, 1978; U.S. Pat. No. 4,899,493 (U.S. Class 49/425) which issued to Baumgarten on Feb. 13, 1990; and U.S. Pat. No. 3,613,313 (U.S. Class 49/420) which issued to Helmick on Oct. 19, 1971.

U.S. Pat. No. 3,722,028 relates to a sliding panel roller assembly wherein a single roller assembly is provided for the upper and lower rollers of a sliding panel with the upper rollers being yieldably maintained on an upper track while a threaded bolt extends through a bore in the panel frame and supports the weights of the panels directly on the lower rollers.

U.S. Pat. No. 4,064,593 relates to a sliding door roller assembly wherein the roller assembly is adjusted from the sides of the door. This is accomplished through the accessibility of limit stop clamp screws through side openings in the door.

U.S. Pat. No. 4,112,622 relates to a roller assembly for a sliding screen door and the like which includes a housing supported as a friction fit in an opening in the edge of the door and which also includes a roller supported in the housing. The roller is spring biased by a flat spring member which constitutes a resilient support for the roller and which is hooked into the housing.

U.S. Pat. No. 4,899,493 relates to a replaceable sliding door roller assembly wherein the roller assembly includes a roller mounted in a roller housing and is carried in a cantilevered manner at one end of a leaf spring. The opposite end of the leaf spring is permanently bent to form a hook which is engageable with a mounting tab on an upper or lower door edge through a mounting insertion gap in the door edge such that the leaf spring extends across a bearing tab. The leaf spring is arranged so that the roller moves into and out of a roller receiving pocket to accommodate imperfections and obstructions in a stationary track on the door frame on which the roller travels.

U.S. Pat. No. 3,613,313 relates to a supporting roller assembly for a sliding panel and which roller assembly includes a spring bias rocker arm having a rounded seating edge seated against the panel edge surface. A track engaging roller on the arm is adjacent one end of the seating edge and attachment means pivotally secured to the arm adjacent the other end of the seating edge secure the arm to the panel for adjusting the arm to shift the point of contact of its seating edge with the panel edge surface in a direction along the seating edge to provide adjustment of the roller toward and away from the panel edge surface.

It will be discerned from the description of the present invention which follows that the invention differs structurally from the prior art as recited above and accomplishes the required adjustability and/or installation and replacement of a sliding panel in a simple and less complex fashion than that taught or suggested by the prior art.

SUMMARY OF THE INVENTION

This invention contemplates a roller arrangement for sliding panels of the type including a pair of parallel, elongated, spaced side members and top and bottom parallel members secured to the ends of the side members to provide a rectangular panel frame. Expanders which carry rollers are partially disposed within the top and bottom members, and tension springs extending along the width of the panel are captured between the expanders and the top and bottom members. Adjustment screws are provided for displacing the expanders inwardly and outwardly of the top and bottom members to respectively increase and decrease the tension on the springs, and clips are disposed within the side members which engage the expanders for limiting the displacement thereof while retaining the expanders partially disposed within the top and bottom members. With the arrangement described, the rollers are self-leveling along the entire width of the panel to facilitate sliding of the panel in tracks in a panel opening and to facilitate installation and of the panel within the opening as may be required.

DETAILED DESCRIPTION OF THE INVENTION

Figure 1:
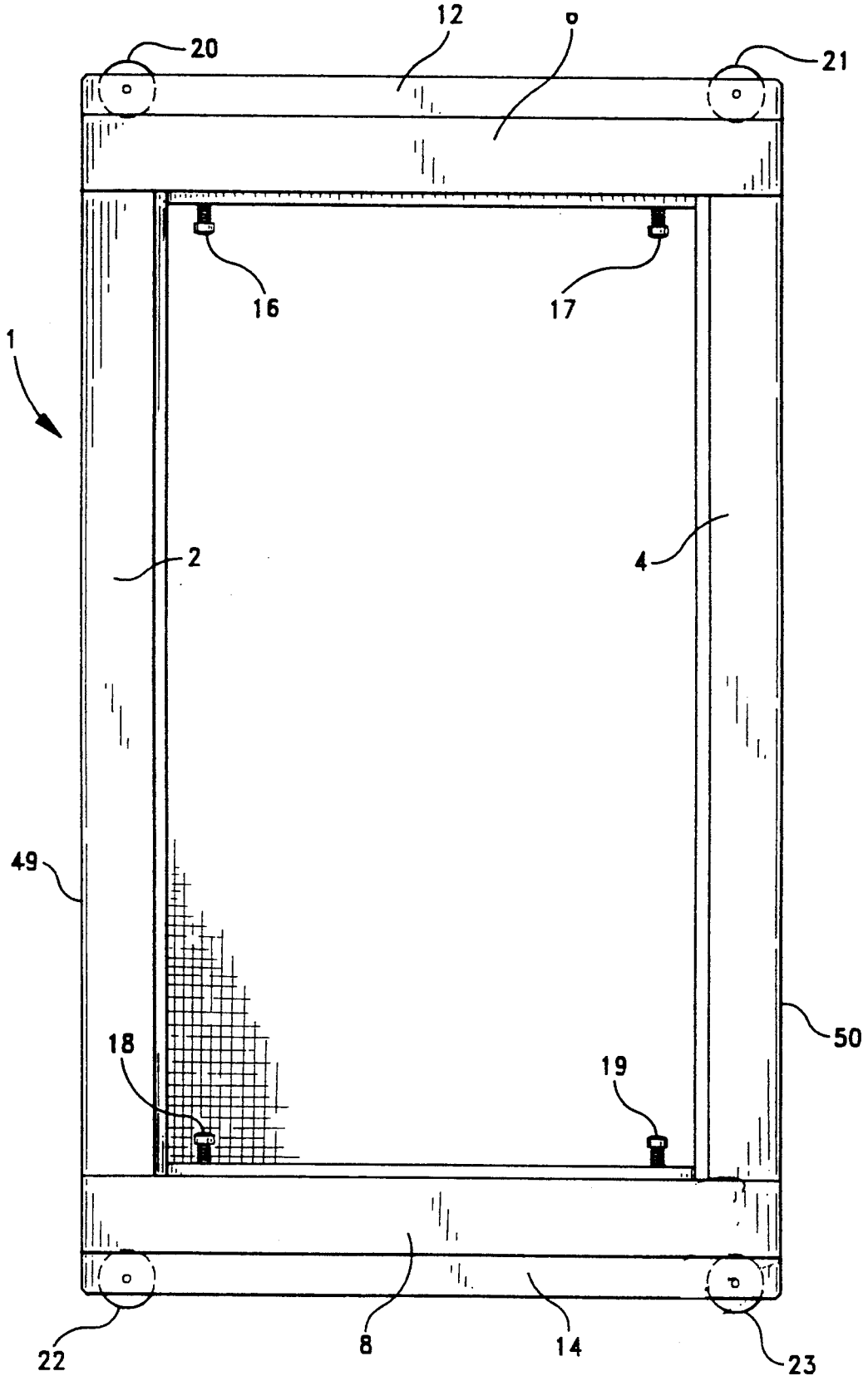
FIG. 1 is a front elevational view generally showing a sliding panel and a roller arrangement for the panel in accordance with the invention.

With reference to FIG. 1, a sliding panel is designated generally by the numeral 1. Sliding panel 1 may be a screen door or a glass door or the like and is shown for illustration purposes as a screen door. Sliding panel 1 is of the type which is fixed within an opening in a wall of a building (not otherwise shown) to provide access to porches, patios and other building areas. To this extent, the panel includes a rigid frame including a pair of parallel elongated spaced side members 2 and 4 and top and bottom parallel members 6 and 8 secured to side members 2 and 4 at the ends thereof as, for example, by screws 10, shown in FIG. 3, which extend into and through corner keys 5 and 7 respectively.

An expander 12 is partially disposed within top member 6 and an expander 14 is partially disposed within bottom member 8. Tension springs are captured between top and bottom members 6 and 8 and expanders 12 and 14, respectively, as will be hereinafter described with reference to FIG. 3.

Figure 3:
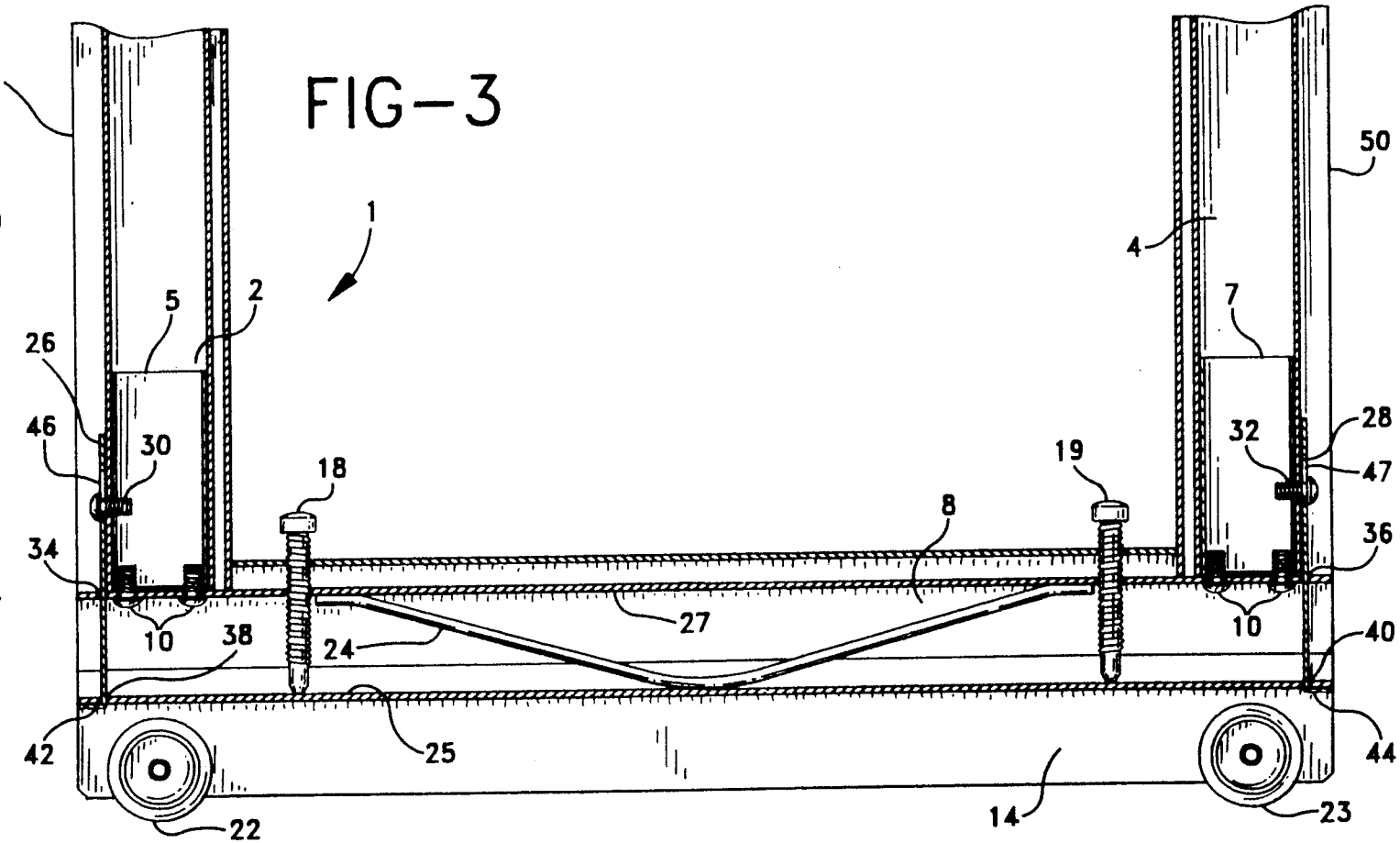
FIG. 3 is a fragmented sectional view particularly showing the details of the invention.

Adjustment screws 16 and 17 extend through top member 6 in threaded engagement therewith and abut expander 12 near each of said expander ends, respectively, and adjustment screws 18 and 19 extend through bottom member 8 in threaded engagement therewith and abut expander 14 near each of said expander ends, as best shown in FIG. 3. The arrangement of screws 16, 17 and 18, 19 with expanders 12 and 14 will be more fully described with reference to FIG. 3.

Expander 12 rotatably supports rollers 20 and 21, one on each end of said expander, and expander 14 rotatably supports rollers 22 and 23, one on each end of said expander. Rollers 20, 21 and 22, 23 fit into upper and lower tracks of the wall opening, whereby panel 1 is slidable within the opening.

Figure 2:
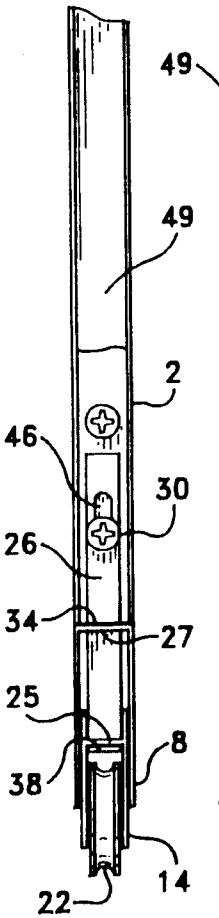
FIG. 2 is a side view particularly showing a feature of the invention which includes a clip for limiting the displacement of expanders shown in FIG. 1.

For purposes of illustration, the particular details of the invention will be described with reference to FIGS. 2 and 3. FIG. 2 is illustrative of the bottom of side member 2, with the bottom of side member 4 being structurally the same. The top of side member 2 and the top of side member 4 are likewise structurally the same, but with the described components inverted as will be readily appreciated. FIG. 3 is illustrative of the bottom portion of panel 1 with the top portion of the panel being structurally the same, but with the described components being likewise inverted.

Expander 14 which has a generally H-shaped cross section (FIG. 2), rotatably supports rollers 22 and 23 (FIG. 3) as heretofore noted and is partially disposed within bottom member 8 of panel 1. Bottom member 8 is in the form of a channel (FIG. 2). A tension spring 24 abuts the cross-bar 25 of the H-shaped cross-section of expander 14 and is disposed within and abuts the base 27 of the channel of bottom member 8 so as to be captured between the expander and the bottom member. Screws 18 and 19 extend through bottom member 8 as aforenoted and abut cross bar 25 of the H-shaped section of expander 14 near each of the expander ends. Thus, when screws 18 and 19 are displaced inwardly, expander 14 is displaced outwardly of bottom member 8 to decrease the tension on spring 24, and when screws 18 and 19 are displaced outwardly, expander 14 is displaced inwardly of bottom member 8 to increase the tension on spring 24. It will be understood that cross-bar 25 of the H-shaped section of expander 14 is wide enough to accommodate the abutment thereon of screws 18 and 19 so that the screws do not interfere with spring 24 when the tension on the spring is increased and the spring is compressed and elongates.

It will be understood that the same arrangement applies to the upper portion of panel 1, wherein expander 12 rotatably supporting rollers 20 and 21 is likewise displaced inwardly and outwardly of upper panel member 6 via the displacement of screws 16 and 17.

Clips 26 and 28 are adjustably secured within side panel members 2 and 4 at the lower ends thereof via screws 30 and 32 (FIG. 3). Base 27 of the channel of bottom member 8 includes slots 34 and 36 near each of the ends of the bottom member. Expander 14 includes slots 38 and 40 in the cross-bar of H-shaped section 25 near each of the ends of the expander. Clip 26 is inserted through slots 34 and 38 and clip 28 is inserted through slots 36 and 40. Clip 26 includes an outwardly extending tab 42 and clip 28 includes an outwardly extending tab 44. Tabs 42 and 44 act to retain expander 14 partially disposed within bottom member 8 and act as stops for limiting the displacement of expander 14 outwardly of bottom member 8.

The upper portions of clips 26 and 28 include elongated slots 46 and 47, as best shown in FIG. 2 with regard to clip 26 and slot 46. Thus, clips 26 and 28 can be longitudinally adjusted along slots 46 and 47 via screws 30 and 32, respectively, to adjustably limit the outward displacement of expander 14.

Thus, with the arrangement described, expander 14 carrying rollers 22 and 23 is adjustably displaceable inwardly and outwardly of bottom member 8 at either or both of the expander ends via the outward or inward displacement, respectively, of either or both of the screws 18 and 19, with said outward displacement being adjustably limited at each of the ends of bottom member 8 by clips 26 and 28 via screws 30 and 32 engaging slots 46 and 47, respectively and which clips also retain expander 14 partially within frame member 8. It will therefore be appreciated that the structural arrangement of bottom member 8, expander 14, spring 24, adjustment screws 18 and 19 and clips 26 and 28 provide self-leveling of rollers 22 and 23 along the entire width of panel 1.

Although the aforegoing features of the invention have been described for purposes of illustration with reference to the bottom of panel 1, it will be appreciated that a like arrangement is provided for the top of the panel as will be discerned from FIG. 1, but with the several components inverted as aforenoted.

It will be appreciated that side members 2 and 4 may carry suitable longitudinally extending caps such as 49 (FIGS. 1, 2 and 3), and 50 (FIGS. 1 and 3) which can be removed when the adjustment of the clips such as 26 and 28 is required, and which can be installed over the side members when the adjustment has been completed to enhance the aesthetic characteristics of panel 1.

There has thus been described a roller arrangement for a sliding panel Expanders are partially disposed within top and bottom members of the panel frame and rotatably support rollers which ride in upper and lower tracks of a panel opening. Tension springs are captured between the expanders and the respective top and bottom members. Adjustment screws are provided for displacing the expanders inwardly or outwardly of the top and bottom members for increasing or decreasing the tension on the springs. Clips are adjustably disposed within panel side members for retaining the expanders partially within the top and bottom members and for limiting the outward displacement of the expanders. The arrangement described provides a self-leveling of the rollers along the entire width of the panel. It will thus be recognized that sliding of the panel in the tracks is facilitated, as is installation and replacement of the panel within the opening, as may be required.

With the above description of the invention in mind, reference is made to the claims appended hereto for a definition of the scope of the invention.

What is claimed is:

1. A roller arrangement for a sliding panel of the type including a pair of parallel, elongated, spaced side members having top and bottom ends and defining a panel length and top and bottom parallel members secured to the top and bottom ends, respectively, of the side members and defining a panel width, said roller arrangement comprising:

a first expander extending along the top member and disposed partially therewithin, said first expander supporting a pair of rollers, one near each end of said first expander;

first resilient means captures between the first expander and the top member for exerting a force against said first expander;

a second expander extending along the bottom member and disposed partially therewithin, said second expander supporting a pair of rollers, one near each end of said second expander;

second resilient means captures between the second expander and the bottom member for exerting a force against said bottom member;

first displacing means for displacing the first expander inwardly and outwardly of the top member against the force exerted by the first resilient member;

second displacing means for displacing the second expander inwardly and outwardly of the bottom member against the force exerted by the second resilient member;

first retaining and limiting means for retaining the first expander partially within the top member and for limiting the displacement of said first expander outwardly of said top member;

second retaining and limiting means for retaining the second expander partially within the bottom member and for limiting the displacement of said second expander outwardly of said bottom member;

the top and bottom members being in the from of a channel having a base;

the first and second expanders being H-shaped in cross-section, said H-shaped cross-section having a cross bar;

the first resilient means being disposed within and abutting the base of the channel of the top member and abutting the cross bar of the first expander so that said first resilient means is captured between the top member and the first expander;

the second resilient means being disposed within and abutting the base of the channel of the bottom member and abutting the cross bar of the second expander so that said second resilient means is captured between the bottom member and the second expander; and the first displacing means including a first screw in threaded engagement with the top member near one end of said top member and extending through said top member, and abutting the cross-bar of the H-shaped section of the first expander near one end of said cross-bar, a second screw in threaded engagement with the top member near an opposite end of said top member and extending through said top member, and abutting the cross-bar of the H-shaped section of the first expander near an opposite end of said cross-bar, and said first and second screws being displaced inwardly so that the first expander is displaced outwardly of the top member at the one and the opposite ends of said top member, whereby the force exerted by the first resilient means on said first expander is decreased, and being displaced outwardly so that said first expander is displaced inwardly of said top member at said one and opposite ends, whereby the force exerted by the first resilient means on said first expander is increased.

2. A roller arrangement as described by claim 1, wherein the first retaining and limiting means includes:

a first clip secured to one of the parallel, elongated, spaced side members at one end of said one side member;

a second clip secured to the other of the parallel, elongated, spaced side members at an end of said other side member corresponding to the one end of the one side member;

the first clip including first engaging means engaging the cross-bar of the H-shaped cross-section of the first expander at one end of said first expander;

the second clip including second engaging means engaging the cross-bar of the H-shaped cross-section of the first expander at an opposite end of said first expander; and the first and second engaging means being effective for retaining the first expander partially within the top member and for limiting the displacement of said first expander outwardly of said top member.

3. A roller arrangement as described in claim 2, wherein:

the first and second clips are secured to the one and the other of the parallel, elongated, spaced side members so as to be longitudinally adjustable relative thereto.

4. A roller arrangement as described by claim 2, wherein the second retaining and limiting means includes:

a third clip secured to one of the parallel, elongated, spaced side members at the opposite end of said one side member;

a fourth clip secured to the other of the parallel, elongated, spaced side members at an end of said other side member corresponding to the opposite end of the one side member;

the third clip including third means engaging the cross-bar of the H-shaped cross-section of the second expander at one end of said second expander;

the fourth clip including fourth means engaging the cross-bar of the H-shaped cross-section of the second expander at an opposite end of said second expander; and the third and fourth means being effective for retaining the second expander partially within the bottom member and for limiting the displacement of said second expander outwardly of said bottom member.

5. A roller arrangement as described by claim 4, wherein:

the third and fourth clips are secured to the one and the other of the parallel, elongated, spaced side members so as to be longitudinally adjustable relative thereto.

6. A roller arrangement for a sliding panel of the type including a pair of parallel, elongated, spaced side members having, top and bottom ends and defining a panel length and top and bottom parallel members secured to the top and bottom ends, respectively, of the side members and defining a panel width, said roller arrangement comprising:

a first expander extending along the top member and disposed partially therewithin, said first expander supporting a pair of rollers, one near each end of said first expander;

first resilient means captured between the first expander and the top member for exerting a force against said first expander;

a second expander extending along the bottom member and disposed partially therewithin, said second expander supporting a pair of rollers, one near each end of said first expander;

second resilient means captured between the second expander and the bottom member for exerting a force against said bottom member;

first displacing means for displacing the first expander inwardly and outwardly of the top member against the force exerted by the first resilient member;

second displacing means for displacing the second expander inwardly and outwardly of the bottom member against the force exerted by the second resilient member;

first retaining and limiting means for retaining the first expander partially within the top member and for limiting the displacement of said first expander outwardly of said top member;

second retaining and limiting means for retaining the second expander partially within the bottom member and for limiting the displacement of said second expander outwardly of said bottom member;

the top and bottom members being in the form of a channel having a base;

the first and second expanders being H-shaped in cross-section, said H-shaped cross-section having a cross bar;

the first resilient means being disposed within the abutting the base of the channel of the top member and abutting the cross bar of the first expander so that said first resilient means is captured between the top member and the first expander;

the second resilient means being disposed within and abutting the base of the channel of the bottom member and abutting the cross bar of the second expander so that said second resilient means is captured between the bottom member and the second expander; and the second displacing means including a third screw in threaded engageable with the bottom member near one end of said bottom member and extending through said bottom member, and abutting the cross-bar of the H-shaped section of the second expander near one end of said cross-bar, a fourth screw in threaded engagement with the bottom member near an opposite end of said bottom member and extending through said bottom member, and abutting the cross-bar of the H-shaped section of the second expander near an opposite end of said cross-bar, said third and fourth screws being displaced inwardly so that the second expander is displaced outwardly of the bottom member at the one and the opposite ends of said bottom member, whereby the force exerted by the second resilient means on the second expander is decreased, and being displaced inwardly of said bottom member at said one and opposite ends, whereby the force exerted by the second resilient means on said second expander is increased.

7. A roller arrangement as described by claim 6, wherein the first retaining and limiting means includes:

a first clip secured to one of the parallel, elongated, spaced side members at one end thereof of said one side member,;

a second clip secured to the other of the parallel, elongated, spaced side members at an end of said other side member corresponding to the one end of the one side member;

the first clip including first engaging means engaging the cross-bar of the H-shaped cross-section of the first expander at one end of said first expander;

the second clip including second engaging means engaging the cross-bar of the H-shaped cross-section of the first expander at the opposite end of said first expander; and the first and second engaging means being effective for retaining the first expander partially within the top member and for limiting the displacement of said first expander outwardly of said top member.

8. A roller arrangement as described by claim 7, wherein:

the first and second clips are secured to the one and the other of the parallel, elongated, spaced side members so as to be longitudinally adjustable relative thereto.

9. A roller arrangement as described by claim 6, wherein the second retaining and limiting means includes:

a third clip secured to one of the parallel, elongated, spaced side members at the opposite end of said one side member;

a fourth clip secured to the other of the parallel, elongated, spaced side members at an end of said other side member corresponding to the opposite end of the one side member;

the third clip including third means engaging the cross-bar of the H-shaped cross-section of the second expander at one end of said second expander;

the fourth clip including fourth means engaging the cross-bar of the H-shaped cross-section of the second expander at an opposite end of said second expander; and the third and fourth means being effective for retaining the second expander partially within the bottom member and for limiting the displacement of said second expander outwardly of said bottom member.

10. A roller arrangement as described by claim 9, wherein:

the third and fourth clips are secured to the one and the other of the parallel, elongated, spaced side members so as to be longitudinally adjustable relative thereto.

* * * * *